US006360735B1

(12) United States Patent
Larson et al.

(10) Patent No.: US 6,360,735 B1
(45) Date of Patent: Mar. 26, 2002

(54) ECCENTRIC FOR ARCHERY BOW WITH LET-OFF ADJUSTMENT MODULE

(75) Inventors: Marlow W. Larson, Ogden, UT (US); Michael D. Selover, Baxter, IA (US)

(73) Assignee: Browning, Morgan, UT (US)

( * ) Notice: Subject to any disclaimer, the term of this patent is extended or adjusted under 35 U.S.C. 154(b) by 0 days.

(21) Appl. No.: 09/704,222

(22) Filed: Nov. 1, 2000

(51) Int. Cl.[7] ..... F41B 5/10
(52) U.S. Cl. ..... 124/25.6; 124/900
(58) Field of Search ..... 124/25.6, 900

(56) References Cited

U.S. PATENT DOCUMENTS 5,791,323 A * 8/1998 Dunlap ..... 124/25.6
5,934,265 A * 8/1999 Darlington ..... 124/25.6
6,082,346 A * 7/2000 Andrews et al. ..... 124/25.6
6,082,347 A * 7/2000 Darlington ..... 124/25.6
6,112,732 A * 9/2000 Larson ..... 124/25.6

* cited by examiner

*Primary Examiner*—John A. Ricci
(74) *Attorney, Agent, or Firm*—L. Grant Foster; Holland & Hart

(57) ABSTRACT

An adjustable eccentric for a compound archery bow includes a let-off adjustment module that pivots between two let-off positions. Adjusting the module between a first let-off position and a second let-off position effectively changes the distance between the cable and the pivot axis of the eccentric at full draw, which changes, in turn, the let off. The eccentric is also adjustable to change the draw length within a given range. A dampening device is further secured to the eccentric at a location on the cable take-up groove to absorb and reduce noise generated upon full draw of the archery bow. A weighted idler may also be provided to reduce undesirable shock or recoil.

26 Claims, 10 Drawing Sheets

ECCENTRIC FOR ARCHERY BOW WITH LET-OFF ADJUSTMENT MODULE

TECHNICAL FIELD

This invention relates to archery bows, and, more particularly, to eccentrics for archery bows.

BACKGROUND OF THE INVENTION

Archery bows, particularly compound archery bows, have evolved considerably in recent times. Compound archery bows rely on a mechanical advantage provided by one or more cams with interconnecting cables which allow the archer to draw the compound archery bow beyond the peak draw weight until a let off draw weight is achieved. The energy stored in the limbs of a compound archery bow when fully drawn is therefore greater that the energy stored in the limbs of a traditional archery bow where the archer must hold the peak draw weight until the arrow is launched. The let off of a compound archery bow allows the archer to hold substantially less than the peak draw weight (typically 50% to 80% of the peak draw weight) when aiming and shooting the archery bow.

Efforts are continually being made to improve all aspects of performance of a compound archery bow. Many variables affect the performance of a compound archery bow, including without limitation the axle-to-axle length, the brace height, the peak draw weight, the configuration of the eccentric cam(s), the length of the bowstring, and many others. Design factors of particular importance to consumers include draw length and draw weight adjustability, as well as percentage of let off relative to the peak draw weight.

The advantages of single-cam archery bows are well known. Single cam archery bows tend to shoot more quietly than dual-cam archery bows and are easier to maintain, since there is only one eccentric or cam. In addition, single-cam archery bows do not experience the timing problems which can plague dual-cam archery bows, where both of the cams or eccentrics must rotate precisely in unison to achieve optimal accuracy.

A common problem associated with traditional compound archery bows is that every time the compound archery bow needs certain types of adjustments, such as changing the draw length, a bow press is generally required to effect such changes. In using a bow press, the archery bow is anchored to the bow press and the limbs are tensioned so that the bowstring becomes relaxed and adjustments to the mechanical features of the archery bow and the eccentric(s) can be made.

Bow presses are cumbersome and difficult to use. In addition, many archers also participate in bowhunting, an activity that does not lend itself well to use of a bow press. While portable bow presses exist, these bow presses are nonetheless cumbersome to take and awkward to use in the field. Bow presses, even portable ones, also take up cargo space in situations where cargo space is placed at a high premium.

One of the more common adjustments that archers desire to make to their archery bows relates to the percent let off of the peak draw weight. Traditionally, one of the only ways to change the percent let off of a compound archery bow has been to change the configuration of the eccentric(s) or cam(s). The peripheral configuration of the eccentric or cam generally dictates the archery bow's let off relative to the peak draw weight of the bow. Changing the configuration of the cam or eccentric will also, however, change many other performance aspect of the compound archery bow, including the draw length of the bow.

Still another problem with compound archery bows relates to the noise created when the cables and/or bowstring slap against the portions of the eccentric(s) or idler when the archery bow is at full draw. Because game animals have tremendous hearing ability, any noise from the compound archery bow must be minimized and preferably eliminated all together when bowhunting.

In view of the foregoing, there is a need to develop an archery bow that is highly adjustable, both with respect to draw length and percent let off relative to the peak draw weight. There is a further need to reduce or eliminate audible sounds that result from drawing a compound archery bow.

OBJECTS AND SUMMARY OF THE INVENTION

It is a primary object of the present invention to provide an adjustable eccentric for a compound archery bow.

Another object of the present invention is to provide an eccentric for a compound archery bow with a let-off adjustment module.

Still another object of the present invention is to provide an eccentric for an archery bow that will allow adjustments to be made to the draw length and percent let off without the need of a bow press.

Another object of the present invention is to provide an eccentric for an archery bow comprising a let-off adjustment module that pivots between two let-off positions.

Yet another object of the present invention is to provide a dampening device coupled to the eccentric for reducing noise upon launching an arrow from the archery bow.

The foregoing objects of the present invention are achieved by a novel adjustable eccentric for a compound archery bow. The eccentric includes a let-off adjustment module that pivots between two let-off positions: in a preferred embodiment between a 65% let-off position and an 80% let-off position. The let-off adjustment module can be adjusted without a bow press; that is, while the archery bow is in a rest position and the string is tensioned between the two archery bow limbs. Adjusting the module between a first let-off position and a second let-off position effectively changes the distance between the cable and the pivot axis of the eccentric at full draw, which changes, in turn, the let off. The eccentric is also adjustable to change the draw length within a range of five inches. Draw length adjustments can be made in one-half inch increments. A dampening device is further secured to the eccentric at a location on the cable take-up groove to absorb and reduce noise generated upon drawing the archery bow prior to launching an arrow.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
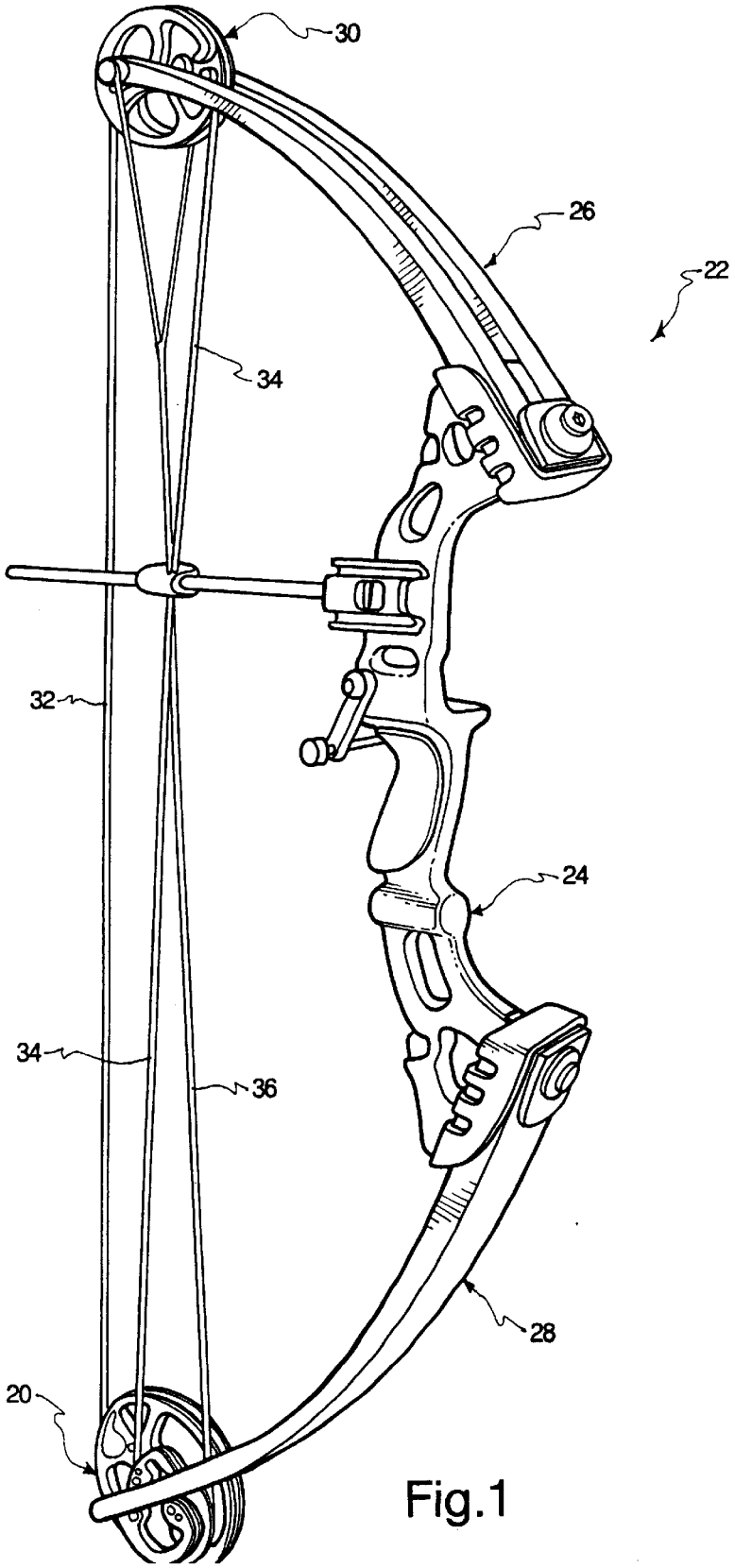
FIG. 1 is a perspective view of an archery bow including an eccentric with a let-off adjustment module according to the present invention.

The present invention relates to an eccentric 20 utilized in connection with a compound archery bow 22. The eccentric 20 according to the present invention can be utilized in connection with any conventional compound archery bow which has a handle riser portion 24, an upper limb 26 coupled to the handle riser, and a lower limb 28 coupled to the handle riser. In the embodiment shown in FIG. 1, the upper limb 26 involves split-limb technology as compared to the bottom limb 28, which is a solid limb. Those skilled in the art will understand that the present invention may be used in connection with either dual solid-limb or dual split-limb compound archery bows, or even with a compound archery bow that has one split limb and one solid limb.

Referring still to the embodiment of FIG. 1, a single cam archery bow is shown. An eccentric 20 comprises the only eccentric utilized in connection with the archery bow in this preferred embodiment. An idler 30 is concentrically and rotatably mounted to the upper limb 26. Details of the idler are described below. The single-cam archery bow 22 shown in FIG. 1 further includes a bowstring 32, a first cable 34, which is a pay-out cable, and a second cable 36, which is a take-up cable (See FIGS. 11–13). Cable 34 is payed out from the eccentric 20 and taken up on the idler 30 upon drawing the bowstring 32. Cable 36 taken up by a cable groove formed in the eccentric 20 while simultaneously being payed out from the idler 30 upon drawing the bowstring. Those skilled in the art will understand that although the eccentric 20 is preferably used in connection with a single-cam archery bow 22 as shown in FIG. 1, the cam 20 could be, with appropriate modifications understood by those skilled in the art, attached to the ends of both limbs 26, 28 to function as a dual-cam archery bow without departing from the spirit and scope of the present invention.

FIGS. 2–5 show the details of the eccentric 20 utilized in connection with the archery bow 22 shown in FIG. 1. The eccentric preferably comprises three nesting and functionally interrelated members: a main eccentric body 40, a cable take-up module or segment 42, and a cable pay-out module or segment 44. The segments 42 and 44 are coupled to the main eccentric body 40 by fasteners, such as hex-head machine screws 46, 48, 50. The machine screws are slidably received through oversized apertures (apertures 52, 54 for screw 46, aperture 56 for screw 48, and apertures 58, 60 for screw 50), and subsequently threadedly received by threaded apertures (threaded apertures 52, 64, 66, 68, 74 for screw 46, threaded aperture 72 for screw 48, and threaded aperture 74 for screw 50). Where alternative oversized, slidable apertures are provided for a particular hex-head machine screw and alternative threaded apertures are provided for a particular hex-head machine screw, the various cable segments 42, 44 may adjusted relative to the main eccentric body 40 to change one or more performance characteristics of the archery bow. Details of particular adjustments will be described below.

The cable take-up segment 42 further includes a circular aperture 76 which is rotatably and concentrically mounted over cylindrical post 78. Post 78 has a hollow interior 80 through which an axle (not shown) may be inserted for mounting the eccentric to an archery bow. The eccentric rotates about a pivot point defined by the post 78 and its cylindrical interior 80.

Figure 2:
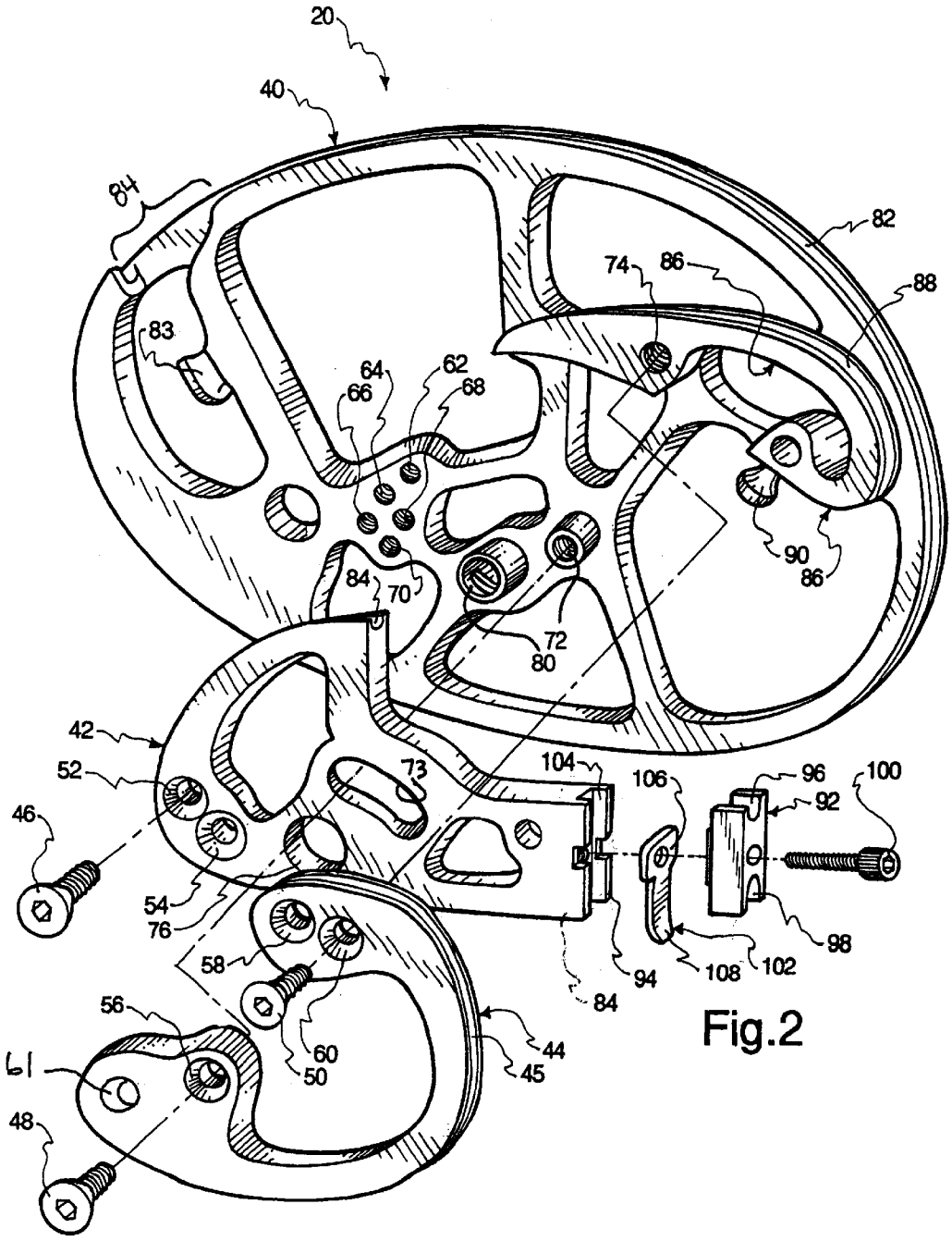
FIG. 2 is an exploded perspective view of an archery bow eccentric with a let-off module according to the present invention.

The main eccentric body includes a unique peripheral shape defined by a string groove 82 which extends around the entire periphery of the eccentric, except for a small area 84 (FIG. 2). A bowstring mounted to the main eccentric body rides inside of the string groove 82 and is secured to the main eccentric body 40 by positioning a looped end of the bowstring around post 83 integrally extending from the eccentric. The configuration of the main eccentric body 40 and the configuration of the corresponding string groove 82 will dictate how much energy will be stored by the archery bow when it is fully drawn. Those skilled in the art will understand that the present invention may be utilized in connection with virtually any eccentric shape or configuration.

The cable segment 42 (FIGS., 2, 4, and 5) functions as a cable take-up element. Segment 42 includes a cable groove 84 for receiving a take-up cable 36 (FIGS. 11–13) as the archery bow is drawn. A stationary cable take-up segment 86 is fixedly secured to the main eccentric body 40. Stationary segment 86 defines a take-up groove portion 88 which forms part of the overall cable take-up groove. Cable groove 84 of the adjustable cable receiving segment 42 and groove 88 defined by stationary cable take-up segment 86 define the majority of the cable take-up groove. A post 90 extends from the stationary cable take-up segment 86 to allow a looped end of the cable to be mounted to the eccentric 20, and so that cable 36 will be received or ride within the cable take-up groove defined by groove 88 of the stationary segment 86 and groove 86 defined by adjustable cable take-up segment 42.

As shown in FIG. 2, a novel aspect of the present invention relates to a let-off adjustment module 92 which is attached to an end 94 of the adjustable cable take-up segment 42. The let-off adjustment module includes opposed grooves 96, 98, either of which can be aligned with cable groove 84 on the adjustable cable take-up segment 42 to finalize the take-up groove. Groove 96 is relatively shallow as compared to groove 98. A hex-head screw 100 is used to secure the adjustment module 92 in the desired position to the end 94 of the adjustable cable take-up segment 42, with one of the grooves 96 or 98 forming part of the overall take-up groove.

The present invention allows the draw length of the archery bow to be adjusted without use of a bow press. Indeed, in the embodiment shown in the drawings, the draw length can be adjusted within a five-inch range to suit the person shooting the archery bow. To adjust the draw length, the set screw 46 (FIG. 2) may be removed from one of the apertures 62, 64, 66, 68, 70, and inserted into another of the apertures to effect a draw length adjustment. Upon moving the adjustable cable take-up segment 42, the post 78 extending from the main eccentric body 40 (FIG. 2) rides inside a slot 73 formed in the adjustable segment 42. The cam can be adjusted at half-inch intervals or inch intervals. A graduated reference indicator 75 is provided on the adjustment segment 42 so that changes to the draw length can be monitored and repeated where desired. The hex-head machine screw 46 is inserted through aperture 52 of adjustable cable take-up segment 42 where threaded anchor apertures 62, 64, or 66 are utilized. If threaded anchor apertures 68 or 70 are utilized, the hex-head machine screw 46 is inserted through aperture 54. Although FIG. 2 shows a limited number of adjustments that can be made pursuant to the specific configuration of the main eccentric body 40 and the adjustable segment 42, those skilled in the art will understand that other configurations with more or fewer adjustment apertures can be provided to provide for a broad range of adjustments to the draw length of the archery bow.

A dampener 102, preferably in the form of a rubber dampener, is secured between the adjustment module 92 and the end 94 of the cable take-up segment 42. The dampener 102 reduces or eliminates noise from the cables and strings when the archery bow is being drawn.

With reference to FIGS. 6–9, the let-off adjustment module 92 is threadedly secured to the rear end 94 of the adjustable cable take-up segment 40 by a fastener 100, which preferably comprises a threaded hex-head screw. The dampening device 102 rides inside a key slot 104 formed in the cable take-up segment 40. The rubber dampener 102 includes an enlarged securing end 106 which includes a central aperture through which fastener 100 is inserted. Dampener 102 further includes a distal end 108 which is of a sufficient length to extend through either of the slots 96, 98 formed in the let-off adjustment module 92. When the archery bow is drawn, the cable rides through the entirety of the cable take-up groove, beginning with the groove extending from post 90 (FIG. 5), which leads to take-up groove 88 on the stationary segment 86, groove 84 (FIG. 2) on the adjustable take-up segment 42, and one of the let-off grooves 96, 98 (FIG. 5), depending on which is selected according to the position of the let-off adjustment module 92. These take-up groove sections combine to provide the full cable take-up groove.

Figure 7:
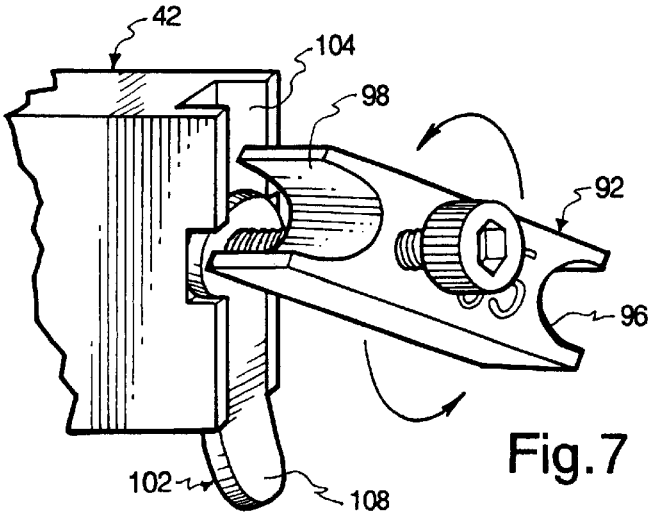
FIG. 7 is a perspective view of the cable take-up segment with the let-off module being rotated to adjust the archery bow let off.
Figure 8:
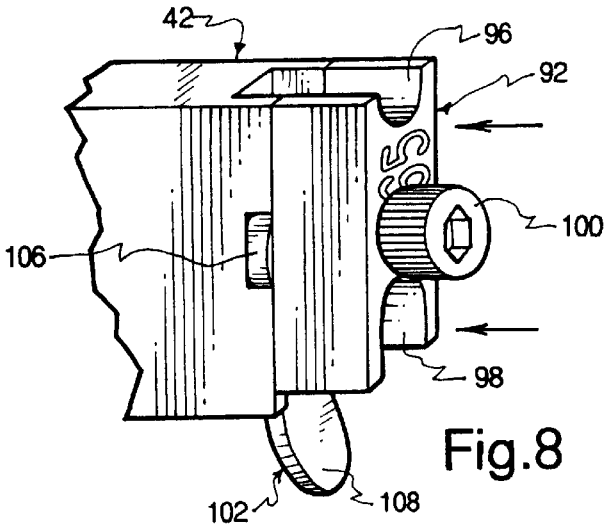
FIG. 8 shows the let-off module being seated within its keyed interlocking position relative to the cable take-up segment.

Referring still to FIGS. 6–9, the let-off adjustment module 92 is alternatively switched between two let-off positions. In a preferred embodiment, the let-off positions are 65% and 80% of the compound archery bow's peak draw weight. Those skilled in the art will understand, however, that any suitable let-off position may be maintained by changing the position of the let-off cable relative to the pivot point of the eccentric when the archery bow is in a full draw position. When the let-off adjustment module 92 is changed, fastener 100 is loosened so that the adjustment module 92 can be pivoted about the fastener 92, as shown in FIG. 7. The let-off adjustment module can rotated or pivoted 180 degrees to change from one let-off position to another let-off position. After the let-off adjustment module 92 is rotated to the desired position, a keyed extension or protrusion 110 (FIG. 9) seats inside of groove 104 so that the let-off adjustment module 92 can be secured in position relative to the adjustable take-up segment 42. Securing the let-off adjustment module 92 in place relative to the take-up adjustment segment 42 compresses the resilient dampener 102 between the module 92 and segment 42. The end flap 108 protrudes beyond the compression area between the module 102 and the segment 42 so that when the cable extends along the entirety of the take-up groove (and thereby extends into groove 98 of the let-off adjustment module 92 as shown in FIG. 8). The flap 108 seats inside of groove 98 to dampen any noise made by the cable when the archery bow is being drawn and is, in fact, in the fully drawn position.

Figure 10:
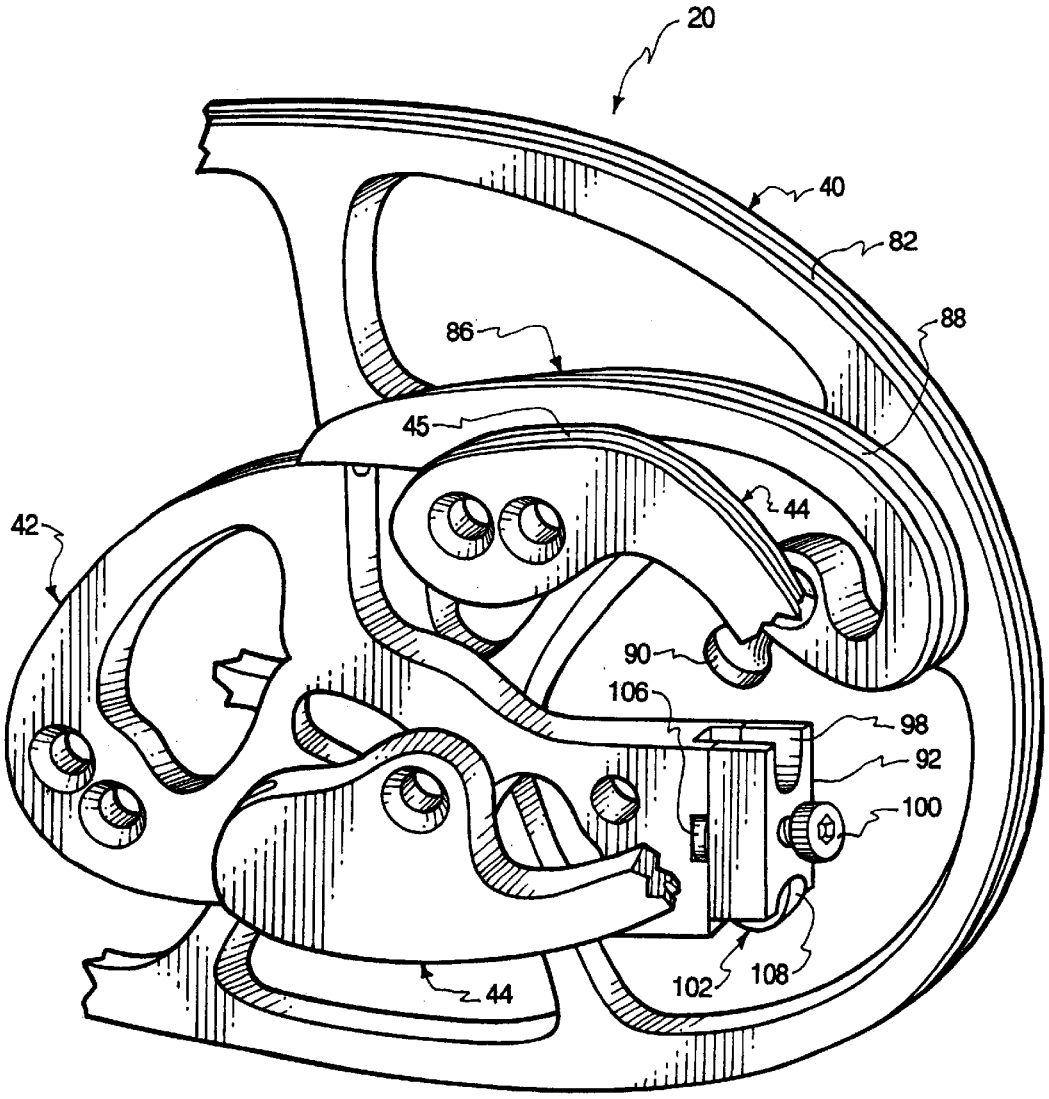
FIG. 10 is a perspective view of the archery bow eccentric of FIG. 2 with the cable pay-out segment being broken away to show the let-off adjustment module.

FIG. 10 shows the flap 108 nested inside of groove 96 to provide a dampening function. Those skilled in the art will understand that similar dampeners may be provided along any portion of any of the bowstring groove 82, cable pay-out groove, or cable take-up groove to dampen noise associated with the bowstring and/or cables as they ride within the respective grooves.

Figure 3:
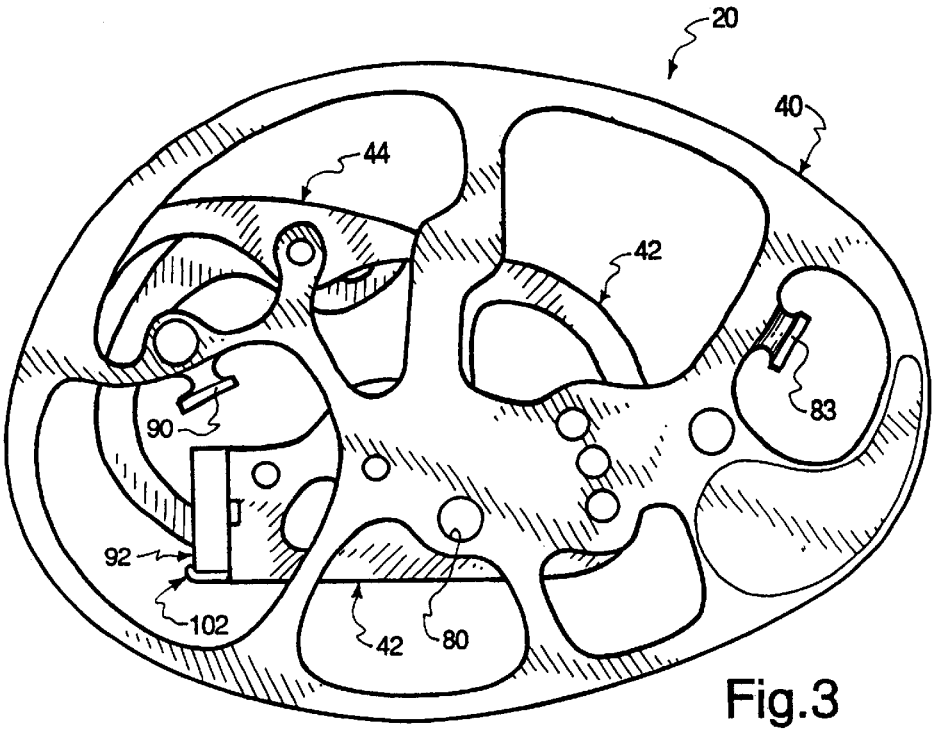
FIG. 3 is a rear elevation view of the archery bow eccentric of FIG. 2.
Figure 4:
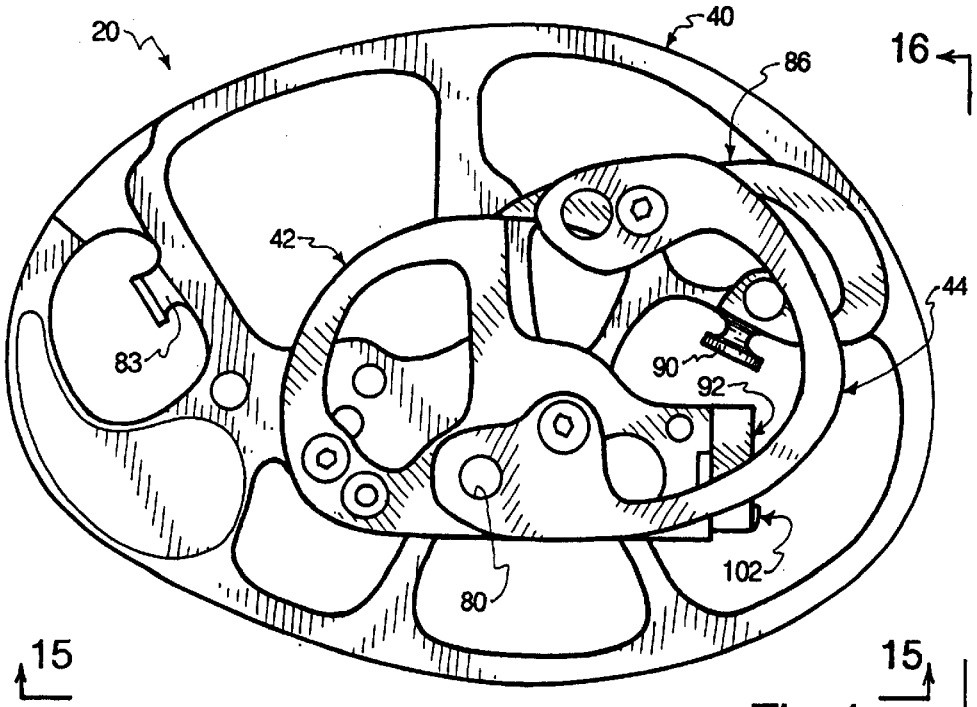
FIG. 4 is a front elevation view of the archery bow eccentric of FIG. 2.
Figure 5:
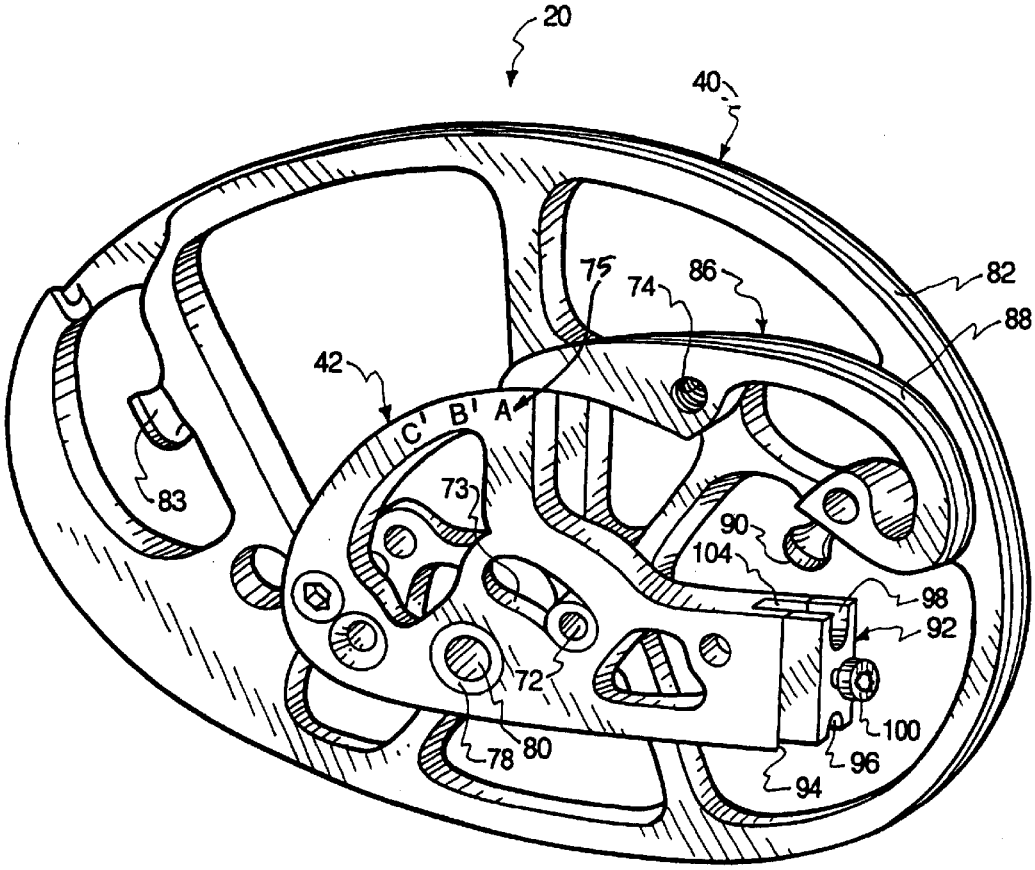
FIG. 5 is a perspective view of the archery bow eccentric of FIG. 2 without the cable pay-out segment attached to the eccentric to better show the let-off adjustment module of the present invention.
Figure 6:
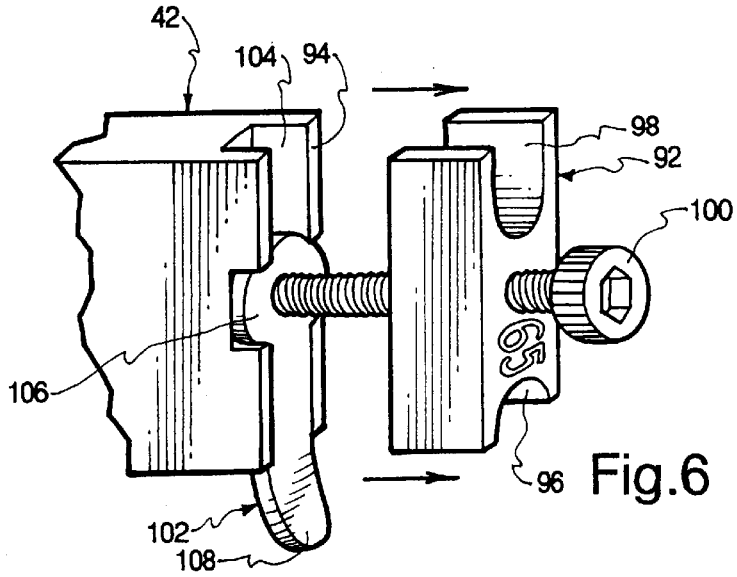
FIG. 6 is a perspective view of a portion of the cable take-up segment with the let-off adjustment module attached, but in a partially exploded view.
Figure 9:
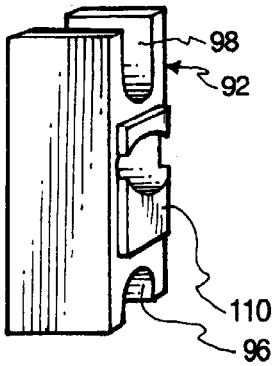
FIG. 9 is a perspective view of the let-off adjustment module showing the keyed protrusion which interlocks with the cable take-up module.
Figure 11:
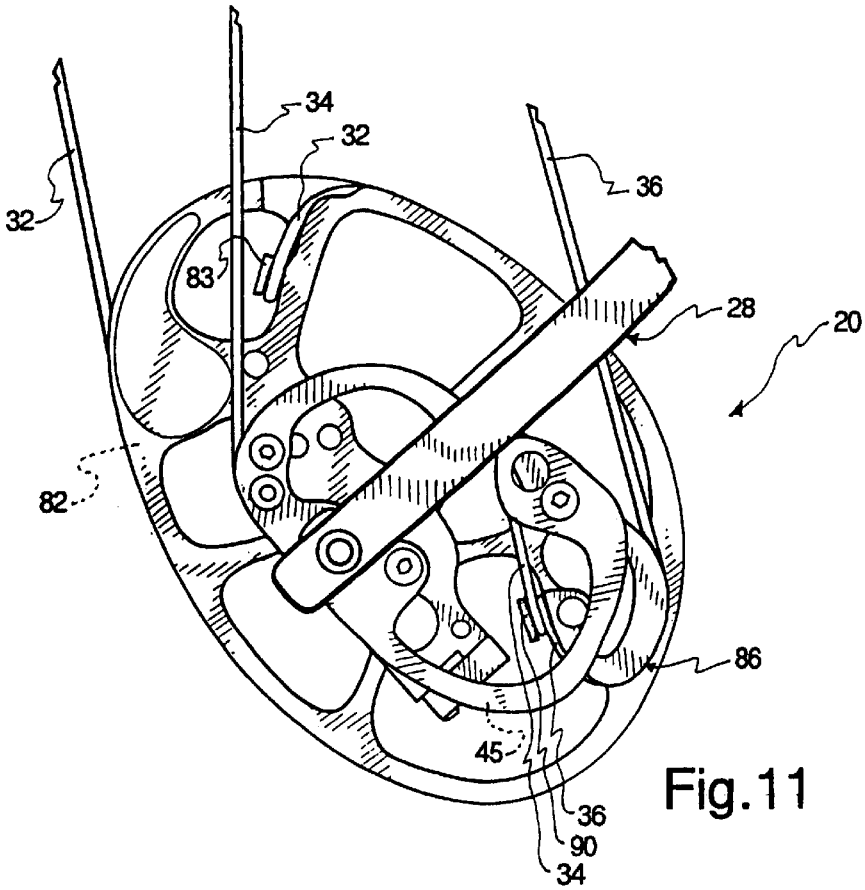
FIG. 11 is a front elevation view of the archery bow eccentric of FIG. 1 installed on an archery bow in a rest position.
Figure 12:
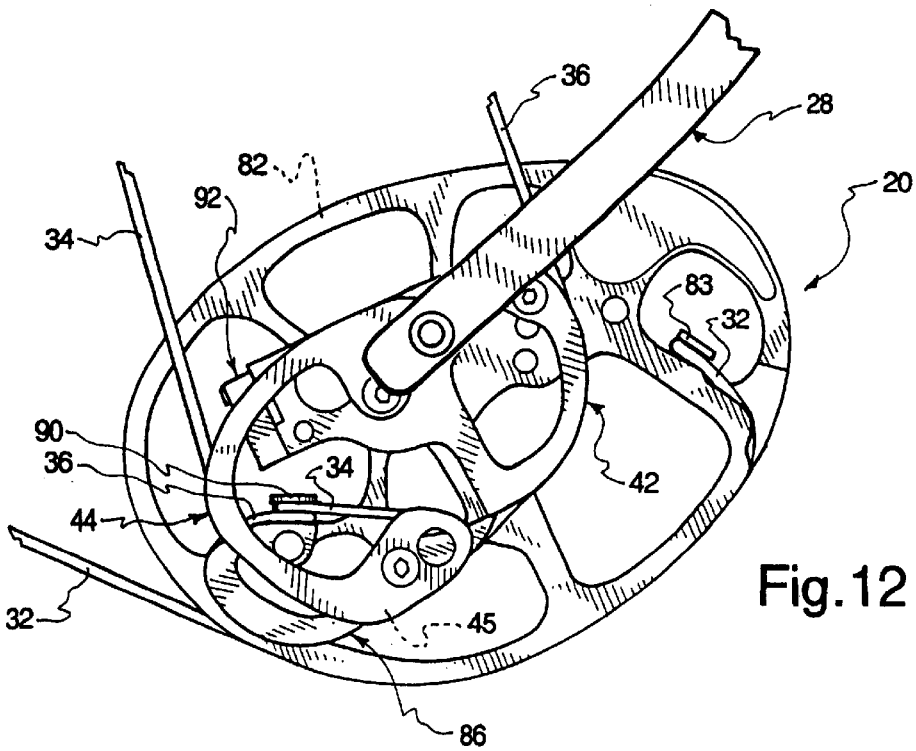
FIG. 12 is a front elevation view of the archery bow eccentric of FIG. 2 installed on an archery bow shown in a partially drawn position.
Figure 13:
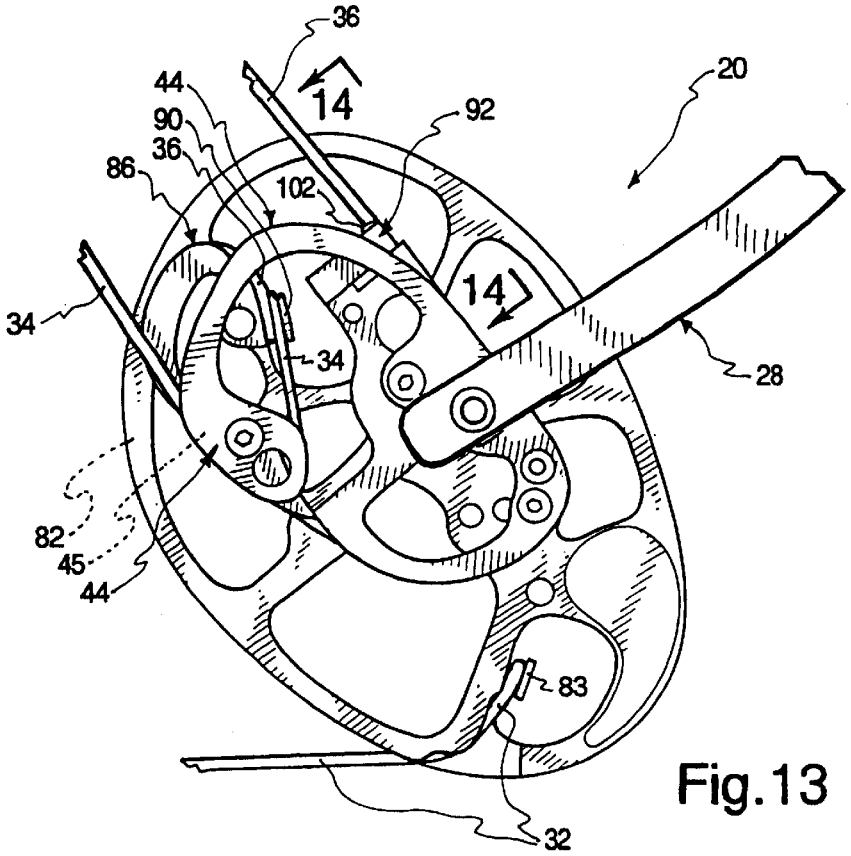
FIG. 13 is a front elevation view of the eccentric of FIG. 2 installed on an archery bow showing the position of the eccentric when the archery bow is in a fully drawn position.
Figure 14:
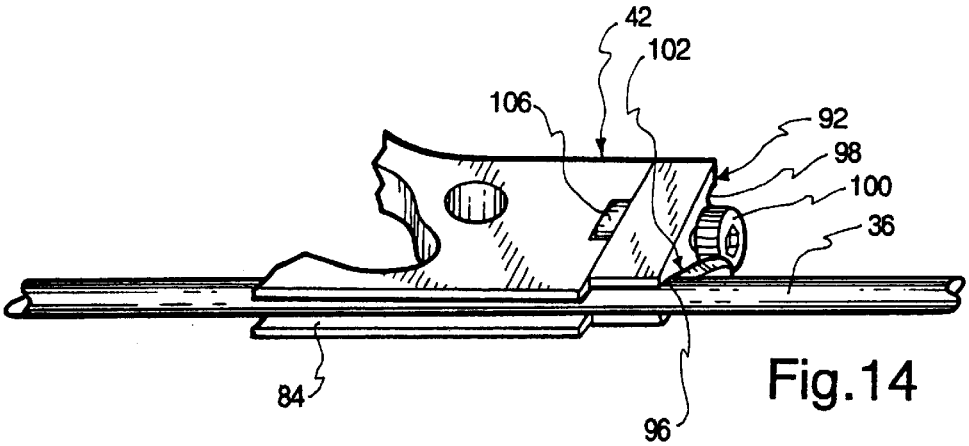
FIG. 14 shows an inverted top perspective view, taken along the line 14—14 of FIG. 13, showing the cable groove formed by the combined adjustment module and cable take-up segment.

FIGS. 11–13 show an archery bow eccentric 20 according to the present invention while the eccentric goes from a rest position (FIG. 11) where the archery bow is not drawn, to a partially at-rest position (FIG. 12) where the archery bow is beginning to be drawn, and ultimately to a fully drawn position (FIG. 13). As shown, the bowstring 32 is received by a majority of the bowstring groove 82 when the archery bow is in the at rest position as shown in FIG. 11. The first cable 34, which is payed-out from the eccentric when the bowstring is drawn and taken-up by the idler when the bowstring is drawn initially rests within substantially the entirety to the cable pay-out groove 45 and is hooked over post 90 by means of a looped end formed on the end of cable 34. The second cable 36, or take-up cable, is taken up by the take-up groove, which is collectively formed by take-up groove portion 88 on stationary segment 86, take-up groove 84 on the adjustable take-up cable segment 42, and one of the grooves 96 or 98, depending on which is employed, on the let-off adjustment module 92. The cable 36 that is taken up by the eccentric 20 when the archery bow is drawn is also looped over post 90 formed on the main eccentric body 40 (FIGS. 2 and 3). As shown in FIG. 13, when the archery bow is in its fully-drawn position, take-up cable 36 fully engages all portions of the take-up groove, and urges the dampening device 102 into the groove being employed on the let-off adjustment module 92. FIG. 14 is an enlarged view, taken along the line 14—14 of FIG. 13, of the cable 36 being taken up by groove 84 of the cable take-up adjustment segment 42 and the groove 96 of the let-off adjustment module 92. The rubber dampener 102 is shown in its operative position. It can be understood from FIG. 14 that changing the depth of one of the grooves 96, 98 will vary the height at which the cable 36 leaves the module, which will also effect and change the let-off of the archery bow. It is the relationship of the height of either groove 96 or groove 98 relative to axle location 80 that determines the let off. When the module is placed in the high let-off position (groove 96), the cable is held further away from the axle location or pivot point 80 as compared to the low let-off position, which allows the cable to fall completely inside the groove 84 (FIG. 2), closer to the pivot point location 80, and provide a greater let off. By changing the let-off adjustment module 92, the draw length of the archery bow will not change to any substantial or significant degree. That is, an archer can change the let-off position of the archery bow by changing the position of the adjustment module 92 without any significant adverse impacts on the draw length adjustments of the archery bow.

Figure 17:
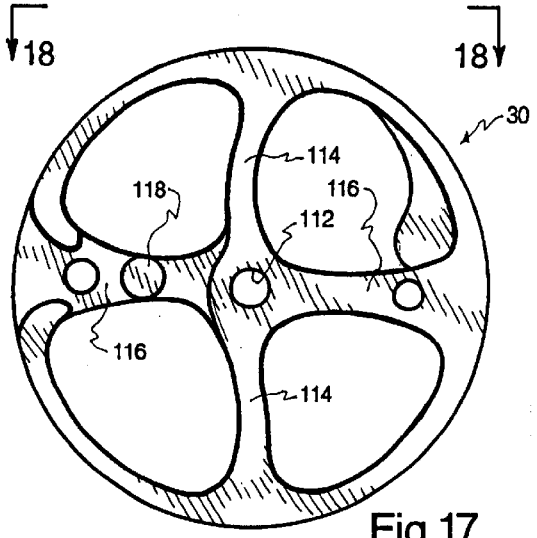
FIG. 17 is a front elevation view of an idler utilized in connection with an archery bow according to the present invention.
Figure 19:
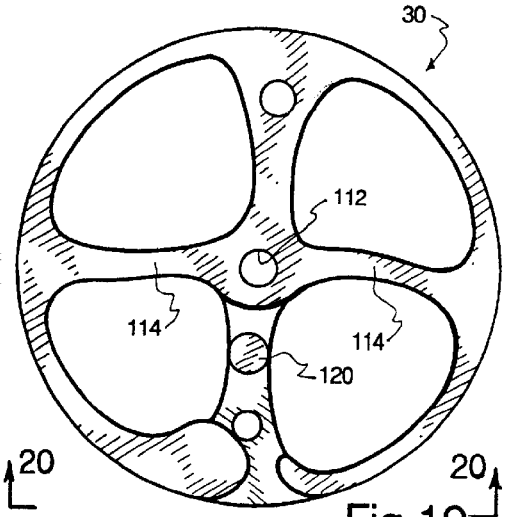
FIG. 19 is a rear elevation view of an idler for an archery bow according to the present invention.
Figure 18:
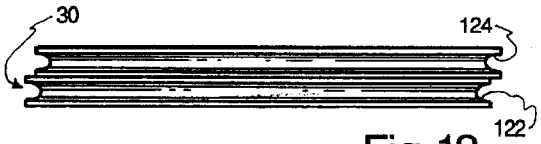
FIG. 18 is a top view of the idler shown in FIG. 17.
Figure 20:
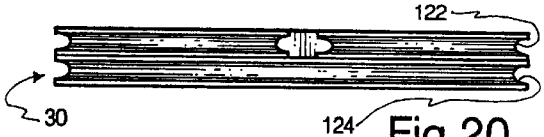
FIG. 20 is a bottom view of the idler of FIG. 19.
Figure 15:
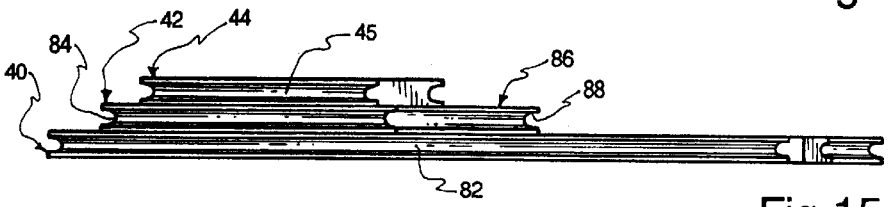
FIG. 15 is a bottom view, taken along the line 15—15 of FIG. 4, of an eccentric according to the present invention.
Figure 16:
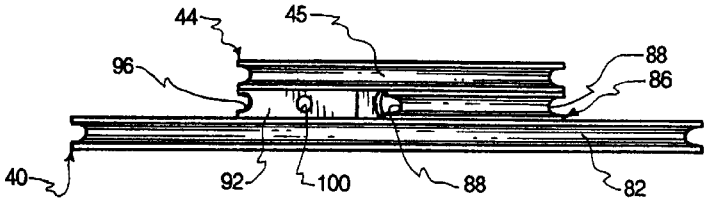
FIG. 16 is a right side view taken along the line 16—16 of FIG. 4, of an eccentric for an archery bow according to the present invention.

FIGS. 17–20 show an idler 30 that may be utilized in connection with the present invention. As shown in FIG. 17, the idler 30 comprises a central, concentric aperture 112 through which an axle is positioned for mounting the idler onto an end of the archery bow. A plurality of spokes or reenforcing ribs 114, 116. Spokes 114 are primarily reenforcing structural members that provide sufficient structure to support the periphery of the idler. Spokes 116 provide posts 118, 120 which provide anchor locations for the bowstring 32 and the cable 34. The bowstring 32 and the cable 34 will have a looped end for inserting over posts 18, 120, respectively. As shown in FIGS. 18 and 20, the bowstring 32 (not shown), and cable 34 (not shown), will ride in one of the grooves 122, 124, depending upon the orientation of the idler when installed on the limb of an archery bow. The dual-track idler 30 will pay out the bowstring when the archery bow is drawn, and take up the cable 34 inside of the grooves 122, 124.

Figure 21:
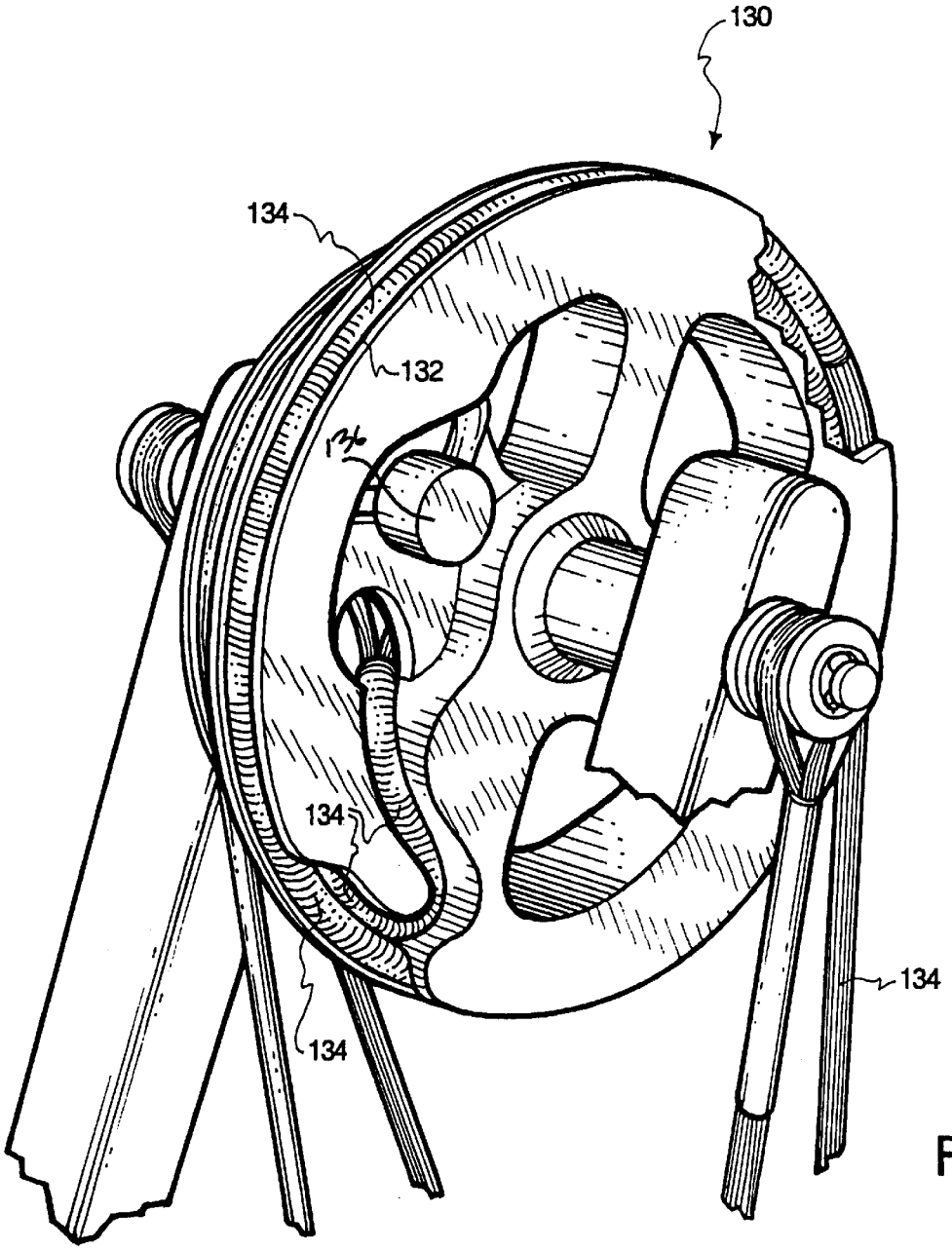
FIG. 21 is a perspective view of an alternative embodiment of an idler that may be utilized in connection with the present invention.

An alternative embodiment of an idler is shown in FIG. 21. Idler 130 includes a first groove 132 in which a bowstring 134 is received. The groove 132 is deep enough that the bowstring may be wrapped around the idler 130 more than 360 degrees so that the bowstring 134 is doubled up for at least a portion of the groove 132. This allows the groove 132 to be formed at any desired depth according to the needs of a particular archery bow. Those skilled in the art will understand that this overlapping cable/bowstring arrangement may be utilized in connection with any cable associated with the archery bow as it wraps around an idler, or with respect to any bowstring or cable operatively attached to an eccentric for an archery bow.

Also shown in FIG. 21 is a post 136, which could be used to receive a looped end of a cable. Alternatively, post 136 could be made of a material other that the material of the body of the idler 130. For example, if the idler is made of aluminum, the post 136 could be made of a denser or lighter material to effect perimeter weighting of the idler. A benefit of the idler configuration shown in FIG. 21 is that the weighted post 136 remains in a predictable, fixed position, which allows the idler (and the location of the post 136) to be calibrated and positioned to minimized undesirable shock or recoil when shooting the archery bow.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

What is claimed is:

1. An eccentric for an archery bow, comprising:

an eccentric body having a periphery, the eccentric providing a let off when the archery bow is at a full draw position;

a string groove formed in the eccentric body to receive a bowstring, the string groove defining a majority of the periphery of the eccentric body;

a cable groove formed in the eccentric body to receive a cable, the cable groove having an effective length;

an adjustable module adjustably coupled to the eccentric adjacent the cable grove, the module being movable between a plurality of positions relative to the cable groove to change the let off.

2. An eccentric for an archery bow according to claim 1 wherein the module is coupled to an end of the cable groove.

3. An eccentric for an archery bow according to claim 1 wherein the module articulates between two let off positions.

4. An eccentric for an archery bow according to claim 1 wherein the module articulates between a 65% let-off position and an 80% let-off position.

5. An eccentric for an archery bow according to claim 1 wherein the cable groove is defined by a cable groove segment of the eccentric that moves relative to the eccentric body, the module being adjustable relative to the eccentric body to change the draw length within a range.

6. An eccentric for an archery bow according to claim 1 wherein the module comprises a pivoting head having a first recess area and a second recess area, the pivoting head being pivotally coupled to the eccentric so that the first recess area and the second recess area can be alternatively aligned with the cable groove.

7. An eccentric for an archery bow according to claim 1 wherein the module comprises a pivoting head having a first recess area and a second recess area, the pivoting head being pivotally coupled to the eccentric so that the first recess area and the second recess area can be alternatively aligned with the cable groove, the first recess area corresponding to a first let-off position and the second recess area corresponding to a second let-off position.

8. An eccentric for an archery bow according to claim 1, further comprising a sound dampener coupled to the eccentric.

9. An eccentric for an archery bow according to claim 1, further comprising a rubber sound dampener coupled to the eccentric.

10. An eccentric for an archery bow according to claim 1, further comprising a sound dampener coupled to the cable groove to engage the cable as the archery bow is drawn.

11. An eccentric for an archery bow, comprising:

an eccentric body defining a non-circular periphery, the eccentric body providing a let off when the archery bow is in a full draw position;

a string groove formed in the eccentric body to receive a bow string;

a cable groove formed in the eccentric body to receive a cable;

an adjustment module adjustably coupled to the eccentric adjacent the cable grove, the module being movable between a plurality of positions relative to the cable groove to change the let off;

a dampener coupled to the eccentric to dampen noise as the archery bow is drawn.

12. An eccentric for an archery bow according to claim 11 wherein the module is coupled to an end of the cable groove.

13. An eccentric for an archery bow according to claim 11 wherein the module articulates between two let off positions.

14. An eccentric for an archery bow according to claim 11 wherein the module articulates between a 65% let-off position and an 80% let-off position.

15. An eccentric for an archery bow according to claim 11 wherein the cable groove is defined by a cable groove segment of the eccentric that moves relative to the eccentric body, the module being adjustable relative to the eccentric body to change the draw length within a five inch range.

16. An eccentric for an archery bow according to claim 11 wherein the module comprises a pivoting head having a first recess area and a second recess area, the pivoting head being pivotally coupled to the eccentric so that the first recess area and the second recess area can be alternatively aligned with the cable groove.

17. An eccentric for an archery bow according to claim 11 wherein the module comprises a pivoting head having a first recess area and a second recess area, the pivoting head being pivotally coupled to the eccentric so that the first recess area and the second recess area can be alternatively aligned with the cable groove, the first recess area corresponding to a first let-off position and the second recess area corresponding to a second let-off position.

18. An eccentric for an archery bow according to claim 11 wherein the dampener comprises a rubber dampener.

19. An eccentric for an archery bow according to claim 11 wherein the dampener comprises a rubber dampener coupled to the cable groove to engage a cable of the archery bow as the archery bow is drawn.

20. An adjustable module for an archery bow eccentric, comprising:

a module body adjustably coupled to an eccentric, the eccentric providing a let off when the archery bow is in a full draw position;

the module body having a pair of channels, the module being transversely pivotable relative to the archery bow eccentric to align alternatively each of the channels with a cable groove of the archery bow eccentric to change the let off.

21. An adjustable module for an archery bow eccentric according to claim 20 wherein the module is coupled to an end of the cable groove.

22. An adjustable module for an archery bow eccentric according to claim 20 wherein the module articulates between two positions.

23. An adjustable module for an archery bow eccentric according to claim 20 wherein the module articulates between a first let-off position and a second let-off position.

24. An adjustable module for an archery bow eccentric according to claim 20 wherein the cable groove is defined by a cable groove segment of the eccentric that moves relative to the eccentric body, the module being adjustable relative to the eccentric body to change the draw length within a five inch range.

25. An adjustable module for an archery bow eccentric according to claim 20 wherein the module comprises a pivoting head having a first recess area and a second recess area, the pivoting head being pivotally coupled to the eccentric so that the first recess area and the second recess area can be alternatively aligned with the cable groove.

26. An adjustable module for an archery bow eccentric according to claim 20 wherein the module comprises a pivoting head having a first recess area and a second recess area, the pivoting head being pivotally coupled to the eccentric so that the first recess area and the second recess area can be alternatively aligned with the cable groove, the first recess area corresponding to a first let-off position and the second recess area corresponding to a second let-off position.

* * * * *